US012782002B2

(12) United States Patent
Uchitani et al.

(10) Patent No.: US 12,782,002 B2
(45) Date of Patent: Nov. 3, 2026

(54) HEAT PUMP UNIT, ANOMALY WORKAROUND HEATING METHOD, AND NON-VOLATILE COMPUTER-READABLE RECORDING MEDIUM

(71) Applicant: Panasonic Intellectual Property Management Co., Ltd., Osaka (JP)

(72) Inventors: Kazuo Uchitani, Shiga (JP); Naoki Yoshida, Kyoto (JP); Masakazu Gotoda, Osaka (JP); Yuki Mabuchi, Shiga (JP); Shogo Sato, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 108 days.

(21) Appl. No.: 18/904,163

(22) Filed: Oct. 2, 2024

(65) Prior Publication Data

US 2025/0116425 A1 Apr. 10, 2025

(30) Foreign Application Priority Data

Oct. 10, 2023 (JP) ..... 2023-174965

(51) Int. Cl.
*F24H 4/02* (2022.01)

(52) U.S. Cl.
CPC ..... *F24H 4/02* (2013.01)

(58) Field of Classification Search
CPC ..... F24H 4/02; F24H 15/215; F24H 15/219; F24D 17/02
See application file for complete search history.

(56) References Cited

U.S. PATENT DOCUMENTS 9,170,030 B2 * 10/2015 Nagata ..... F24H 15/258
2011/0203298 A1 * 8/2011 Kim ..... F24H 15/281 62/204
2014/0291411 A1 * 10/2014 Tamaki ..... F24D 3/18 62/238.7

FOREIGN PATENT DOCUMENTS

EP 2620711 A2 * 7/2013 ..... F24D 19/1072
EP 3026364 A1 * 6/2016 ..... F25B 47/025
EP 3115699 A1 * 1/2017 ..... F24D 17/02
(Continued)

*Primary Examiner* — Lionel Nouketcha
(74) *Attorney, Agent, or Firm* — HSML P.C.

(57) ABSTRACT

Controller (120) for heat pump unit (100) according to an exemplary embodiment includes information acquisition unit (121) configured to acquire an inflow water temperature indicating a temperature of water flowing out of hot water tank (310) into heater (110), and an outflow water temperature indicating a temperature of the water flowing out of heater (110) toward hot water tank (310). Controller (120) further includes normality determination unit (122) configured to determine whether a storage water temperature indicating a temperature of the water inside hot water tank (310) is being acquired properly. Controller (120) further includes setting value update unit (124) configured to update a target storage water temperature to be achieved in hot water tank (310) by the heating operation to a higher value when normality determination unit (122) determines that the storage water temperature is not being acquired properly or there is a possibility that the storage water temperature is not being acquired properly, and a temperature difference between the outflow water temperature and the inflow water temperature is less than a temperature difference threshold.

6 Claims, 5 Drawing Sheets

(56) References Cited

FOREIGN PATENT DOCUMENTS

| | | | | |
|---|---|---|---|---|
| EP | 3431896 | A1 * | 1/2019 | ..... F25B 49/022 |
| JP | 2013-170764 | | 9/2013 | |

* cited by examiner

HEAT PUMP UNIT, ANOMALY WORKAROUND HEATING METHOD, AND NON-VOLATILE COMPUTER-READABLE RECORDING MEDIUM

BACKGROUND

1. Technical Field

The present disclosure relates to a heat pump unit that heats water to be stored in a hot water tank, an anomaly workaround heating method, and a non-volatile computer-readable recording medium. In the description herein, and the claims and the drawings, "water" is not limited to that at a specific temperature, and includes hot water at a predetermined temperature or higher. Although the term "hot water" is sometimes used to facilitate understanding, the term "hot water" is a concept covered by "water" in the description, claims, and drawings.

2. Description of the Related Art

Conventionally, there is a heat pump unit that heats water. For example, PTL 1 describes a heat pump unit configured to measure the temperature inside a hot water tank, storing therein heated water, with a sensor, and controls the operation on the basis of the measurement result.

CITATION LIST

Patent Literature

PTL 1: Unexamined Japanese Patent Publication No. 2013-170764

SUMMARY

However, in the conventional heat pump unit, when a sensor for measuring the water temperature inside the hot water tank fails, the heat pump unit stops operating in order to avoid anomalous compressor operations and a loss in the compressor reliability. In such a situation, a necessary amount of water having necessary temperature cannot be ensured, disadvantageously.

The present disclosure provides a heat pump unit, an anomaly workaround heating method, and a non-volatile computer-readable recording medium for maintaining the water heating operation while avoiding a loss in the reliability of the compressor even in the condition where an accurate water temperature in the hot water tank cannot be acquired properly.

A heat pump unit according to one aspect of the present disclosure is a heat pump unit configured to heat water to be stored in a hot water tank. The heat pump unit according to one aspect of the present disclosure includes: a heater configured to heat water incoming from a hot water tank, through heat exchange between the water and a heating medium having been heated based on compression and expansion; and a controller configured to control a heating operation of the heater. The controller includes an information acquisition unit configured to acquire an inflow water temperature indicating a temperature of the water flowing out of the hot water tank into the heater, and an outflow water temperature indicating a temperature of the water flowing out of the heater toward the hot water tank. The controller further includes a normality determination unit configured to determine whether a storage water temperature indicating the temperature of the water inside the hot water tank is being acquired properly. The controller further includes a setting value update unit configured to update a target storage water temperature to be achieved in the hot water tank by the heating operation to a higher value when the normality determination unit determines that the storage water temperature is not being acquired properly or there is a possibility that the storage water temperature is not being acquired properly, and a temperature difference between the outflow water temperature and the inflow water temperature is less than a temperature difference threshold.

An anomaly workaround heating method according to one aspect of the present disclosure is executed in a heat pump unit including a heater configured to heat water incoming from a hot water tank, through heat exchange between the water and a heating medium having been heated based on compression and expansion; and a controller configured to control a heating operation of the heater, the anomaly workaround heating method including following steps. That is, the anomaly workaround heating method that is one aspect of the present disclosure includes causing an information acquisition unit to acquire an inflow water temperature indicating a temperature of the water flowing out of the hot water tank into the heater, and an outflow water temperature indicating a temperature of the water flowing out of the heater toward the hot water tank. The anomaly workaround heating method that is one aspect of the present disclosure also includes causing a normality determination unit to determine whether a storage water temperature indicating a temperature of the water inside the hot water tank is being acquired properly. The anomaly workaround heating method that is one aspect of the present disclosure also includes causing a setting value update unit to update a target storage water temperature to be achieved in the hot water tank by the heating operation to a higher value when the normality determination unit determines that the storage water temperature is not being acquired properly or there is a possibility that the storage water temperature is not being acquired properly, and a temperature difference between the outflow water temperature and the inflow water temperature is less than a temperature difference threshold.

A non-volatile computer-readable recording medium that is one aspect of the present disclosure records an anomaly workaround heating program executed in a heat pump unit that includes: a heater configured to heat water incoming from a hot water tank, through heat exchange between the water and a heating medium heated based on compression and expansion; and a controller including a processor and configured to control a heating operation of the heater, the anomaly workaround heating program causing the processor of the controller to execute following processing. The processing includes an information acquisition step of acquiring an inflow water temperature indicating a temperature of the water flowing out of the hot water tank into the heater, and an outflow water temperature indicating a temperature of the water flowing out of the heater toward the hot water tank. The processing also includes a normality determination step of determining whether a storage water temperature indicating a temperature of the water in the hot water tank is being acquired properly. The processing also includes a setting value update step of updating a target storage water temperature to be achieved in the hot water tank by the heating operation to a higher value when it is determined that, in the normality determination step, the storage water temperature is not being acquired properly or there is a possibility that the storage water temperature is not being acquired properly, and a temperature difference between the outflow water temperature and the inflow water temperature is less than a temperature difference threshold.

With the heat pump unit, the anomaly workaround heating method, and the non-volatile computer-readable recording medium according to one aspect of the present disclosure, even when the temperature of the water in the hot water tank cannot be acquired accurately, the water heating operation can be continued, and a loss in the reliability of the compressor included in the heat pump unit can be avoided.

DETAILED DESCRIPTIONS

An exemplary embodiment of a heat pump unit, an anomaly workaround heating method, and a non-volatile computer-readable recording medium according to the present disclosure will be described with reference to the drawings. Note that the following exemplary embodiment is one example for explaining the present disclosure, and is not intended to limit the present disclosure in any way. For example, the shapes, the structures, the materials, the components, the relative positional relationships, the connections, the numerical values, the mathematical expressions, the operations performed in the steps of a method and the order of such steps, and the like described in the following exemplary embodiment are provided merely for the illustrative purpose, and may include configurations that are not described below. In addition, although geometric expressions such as being parallel or orthogonal are sometimes used, such expressions are not indicative of mathematical strictness, and permits substantially acceptable errors, deviations, and the like. Furthermore, expressions such as being simultaneous and identical also include substantially acceptable ranges.

In addition, the drawings are schematic representations with some emphases, omissions, and ratio adjustments made as appropriate for the purpose of describing the present disclosure, and may be different in the actual shapes, positional relationships, and ratios.

Furthermore, in the following description, a plurality of aspects may be described comprehensively as one exemplary embodiment. In addition, some of the elements described below are explained as optional elements pertinent to the present disclosure.

Flowcharts are also provided for illustrative purposes only, and the exemplary embodiment of the present disclosure may include processing following a different sequence, e.g., with steps being performed in a different order, a plurality of steps being integrated into one, and one step being split into a plurality of steps.

Figure 1:
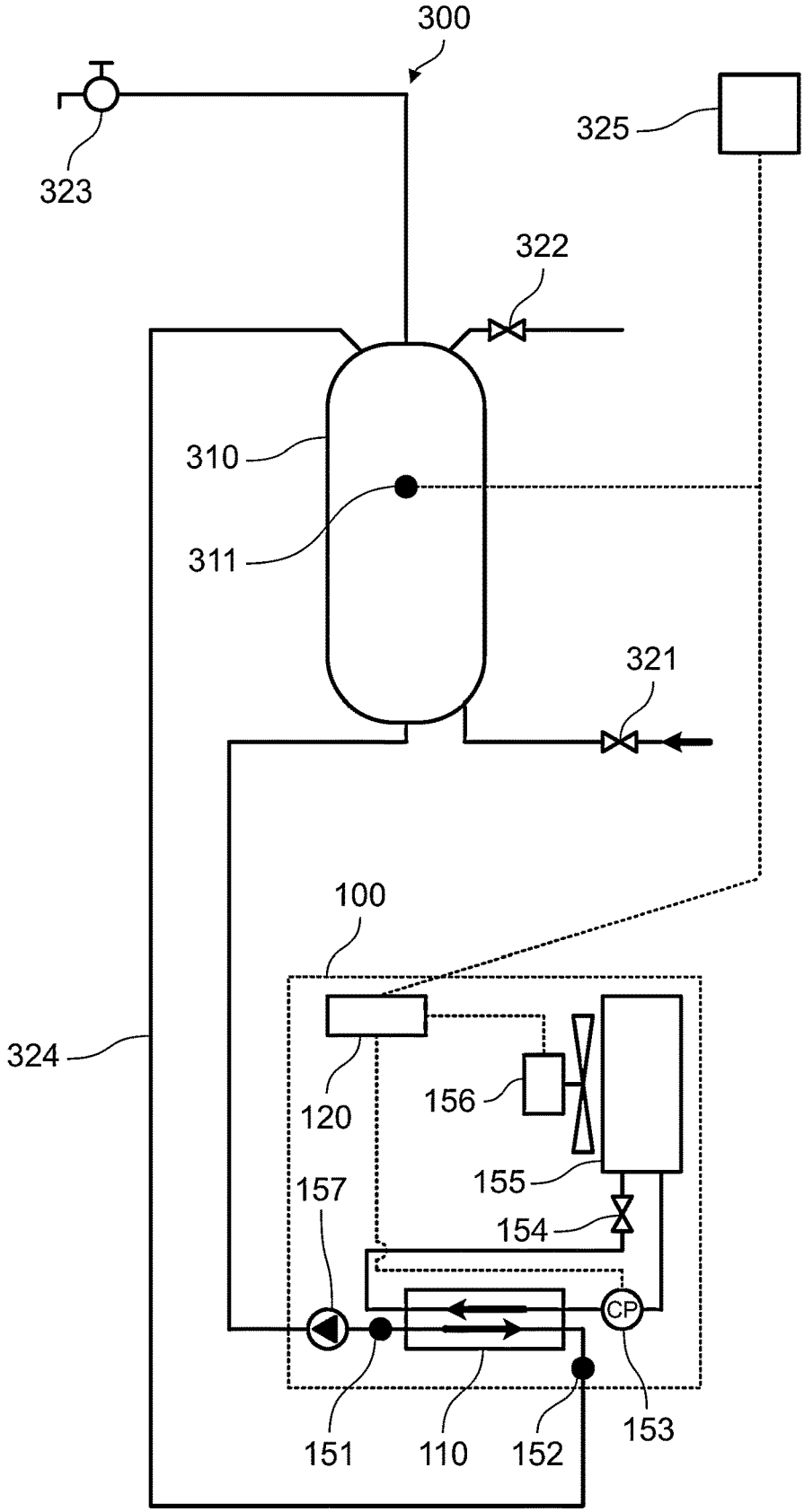
FIG. 1 is a diagram illustrating a configuration of a heat pump unit installed in a hot water system.

FIG. 1 is a diagram illustrating a configuration of heat pump unit 100 installed in hot water system 300. Hot water system 300 is a unit for supplying heated water at a predetermined temperature, and includes hot water tank 310, storage water temperature sensor 311, reduction valve 321, relief valve 322, on-off valve 323, heating pipe 324, and remote controller 325.

Hot water tank 310 is a tank that stores therein water having been heated by heat pump unit 100, and is provided with storage water temperature sensor 311 for measuring the temperature of the water in hot water tank 310. In the present exemplary embodiment, hot water tank 310 stores therein water heated by heat pump unit 100, mixes the heated water with water (e.g., tap water) supplied via reduction valve 321, and stores the water at a predetermined temperature.

Reduction valve 321 is a valve for reducing the pressure of generally available water such as utility water to a predetermined level, and injecting the resultant water into hot water tank 310.

Relief valve 322 is a valve for opening hot water tank 310 to relieve the pressure when the pressure inside hot water tank 310 has reached a predetermined level.

On-off valve 323 is a valve capable of selecting whether to supply the heated water in hot water tank 310 through a faucet, a shower, or the like to the outside.

Heating pipe 324 forms a circulating water passage for supplying the water from hot water tank 310 into heat pump unit 100, and returning the water heated by heat pump unit 100 into hot water tank 310.

Remote controller 325 includes a processor and a communication module. Remote controller 325 is a device capable of acquiring a storage water temperature indicating the temperature of the water in hot water tank 310, from storage water temperature sensor 311, as a piece of information, and of transmitting a target storage water temperature to controller 120 (details of which will be described later) included in heat pump unit 100. Remote controller 325 may also be enabled to set the target storage water temperature by receiving a user operation directly or indirectly via a mobile terminal of the user, for example. It is also possible to connect remote controller 325 to a cloud server, for example, and to enable remote controller 325 to set a target storage water temperature that is suitable for the climate or the environment of the location where hot water system 300 is installed.

Heat pump unit 100 is a unit for heating the water to be stored in hot water tank 310, and includes heater 110 and controller 120. In the present exemplary embodiment, heat pump unit 100 includes inflow water temperature sensor 151, outflow water temperature sensor 152, compressor 153, expansion valve 154, air heat exchanger 155, blower 156, and pump 157. Heater 110, compressor 153, expansion valve 154, and air heat exchanger 155 together form a heat pump circuit in which the heating medium absorbs the heat from the air, and supplies the heat to the water from hot water tank 310.

Heater 110 is a heat exchanger for imparting the heat of the heating medium having been heated by being compressed by compressor 153, to the incoming water from hot water tank 310.

Inflow water temperature sensor 151 is a sensor for measuring and outputting the temperature of the water flowing into heater 110 through heating pipe 324 from hot water tank 310. Outflow water temperature sensor 152 is a sensor for measuring and outputting the temperature of the water flowing out of heater 110 into heating pipe 324 toward hot water tank 310. Inflow water temperature sensor 151 and outflow water temperature sensor 152 are not limited to any particular type of sensors, and one example of these sensors is a thermistor.

Compressor 153 heats the heating medium having been already heated by the temperature of the air in air heat exchanger 155 (details of which will be described later) by compressing the heating medium.

Expansion valve 154 is a decompressor for cooling the heating medium by increasing the volume of the heating medium having been cooled by exchanging heat with water in heater 110.

Air heat exchanger 155 is an evaporator for heating the heating medium having been cooled by expansion valve 154, by allowing the heating medium to exchange heat with the air. In air heat exchanger 155, the heating medium exchanges heat with the air sent by blower 156.

Pump 157 is a pump capable of circulating a predetermined amount of water between hot water tank 310 and heater 110 through heating pipe 324.

Figure 2:
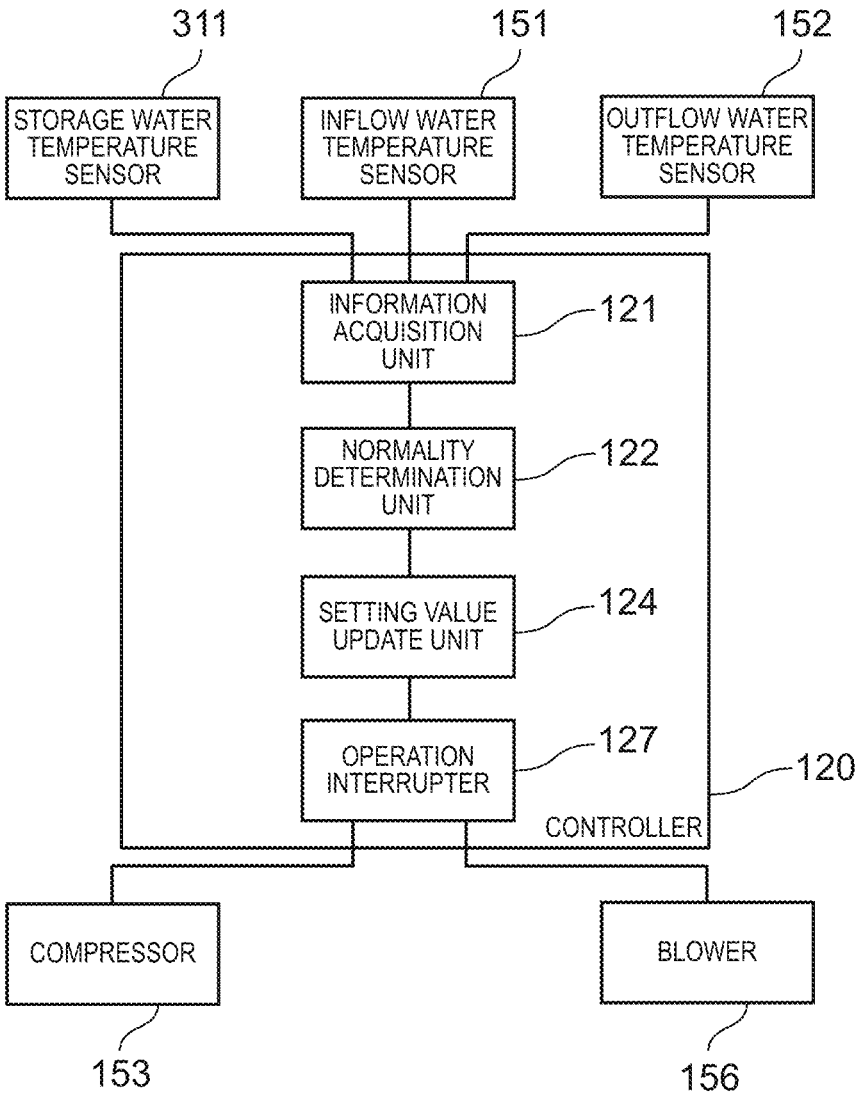
FIG. 2 is a block diagram illustrating a functional configuration of a controller included in the heat pump unit.

FIG. 2 is a block diagram illustrating a functional configuration of controller 120 included in heat pump unit 100. Controller 120 is a device for controlling a heating operation of heat pump unit 100 that includes heater 110, and includes a processor. An anomaly workaround heating program recorded in a nonvolatile recording medium, for example, is installed on controller 120. Controller 120 includes information acquisition unit 121, normality determination unit 122, and setting value update unit 124, as processing units implemented by causing the processor to execute the anomaly workaround heating program. In the present exemplary embodiment, controller 120 includes operation interrupter 127.

Information acquisition unit 121 acquires an inflow water temperature indicating a temperature of the water flowing out of hot water tank 310 into heater 110, from inflow water temperature sensor 151, as a piece of information. Information acquisition unit 121 also acquires an outflow water temperature indicating a temperature of the water flowing out of heater 110 toward hot water tank 310, from outflow water temperature sensor 152, as a piece of information. Information acquisition unit 121 also acquires a storage water temperature indicating a temperature of the water inside hot water tank 310, from storage water temperature sensor 311, as a piece of information. Information acquisition unit 121 may acquire the information of the storage water temperature directly from storage water temperature sensor 311 as illustrated in FIG. 2, may acquire the information via remote controller 325, or may acquire the information indirectly as a heating instruction output from remote controller 325 on the basis of the storage water temperature.

Normality determination unit 122 determines whether a storage water temperature indicating the temperature of the water inside hot water tank 310 is being acquired properly. Examples of conditions in which the storage water temperature is not being acquired properly include a condition in which the storage water temperature that is output as a piece of information deviates from the temperature of the water stored in hot water tank 310, as well as conditions in which storage water temperature sensor 311 is outputting no signal or error information indicating a defect in storage water temperature sensor 311. A method by which normality determination unit 122 determines whether the storage water temperature is being acquired properly is not limited to any method. For example, normality determination unit 122 may determine that the storage water temperature is not being acquired properly when error information indicating that storage water temperature sensor 311 has failed is acquired from remote controller 325, storage water temperature sensor 311, or the like. Normality determination unit 122 may also determine that the storage water temperature is not being acquired properly when the storage water temperature indicates a substantially constant value even while heat pump unit 100 is in operation, or when the storage water temperature indicates a temperature the storage water temperature cannot take. Normality determination unit 122 may also determine that the storage water temperature is not being acquired properly when the temperature difference between the outflow water temperature and the inflow water temperature is less than a predetermined temperature difference threshold. Normality determination unit 122 may also determine that the storage water temperature is not being acquired properly when the inflow water temperature is higher than or equal to an inflow water temperature threshold, and the temperature difference between the outflow water temperature and the inflow water temperature is less than or equal to a predetermined temperature. Normality determination unit 122 may determine whether the storage water temperature is being acquired properly by using a combination of a plurality of methods. Normality determination unit 122 may include a step of determining whether there is a possibility that the storage water temperature is not being acquired properly, before determining whether the storage water temperature is being acquired properly. The determination as to whether there is a possibility that the storage water temperature is not being acquired properly can be made by, for example, comparing the storage water temperature with the water supply temperature or a preset target storage water temperature. Specifically, it is possible to determine that there is a possibility that the storage water temperature is not being acquired properly when the storage water temperature is equal to or lower than a water supply temperature, or higher than or equal to a predetermined target storage water temperature. In the manner described above, normality determination unit 122 may determine whether the storage water temperature is being acquired properly in two stages. Note that the water supply temperature herein is a temperature of the water supplied to the device via a water utility service or the like, and is a temperature of tap water or utility water, for example.

When normality determination unit 122 determines that the storage water temperature is not being acquired properly, setting value update unit 124 determines whether the temperature difference between the outflow water temperature and the inflow water temperature is less than the temperature difference threshold. If the temperature difference is less than the temperature difference threshold, setting value update unit 124 updates the target storage water temperature to be achieved in hot water tank 310 by the heating operation to a higher value. In the present exemplary embodiment, setting value update unit 124 determines whether the temperature difference is less than the temperature difference threshold at a predetermined interval, and updates the target storage water temperature to a target storage water temperature higher than the current temperature, every time the temperature difference becomes less than the temperature difference threshold. Setting value update unit 124 may interrupt the updating of the target storage water temperature when the target storage water temperature exceeds a high temperature threshold. The temperature difference threshold is not limited to any value, but may be 5° C. or higher, for example, and in the present exemplary embodiment, 15° C. is used as a temperature difference threshold. When the temperature difference threshold is less than 5° C., problems such as instability in the control may occur. The high temperature threshold is not limited to any value, but may be set to 90° C., as an example. When normality determination unit 122 determines that there is a possibility that the storage water temperature is not being acquired properly, setting value update unit 124 may determine whether the temperature difference between the outflow water temperature and the inflow water temperature is less than the temperature difference threshold. If the temperature difference is less than the temperature difference threshold, setting value update unit 124 may update the target storage water temperature to be achieved in hot water tank 310 by the heating operation to a higher value.

In the present exemplary embodiment, when normality determination unit 122 determines that the storage water temperature is not being acquired properly, setting value update unit 124 may determine whether the temperature difference between the outflow water temperature and the inflow water temperature is less than the temperature difference threshold. If the temperature difference is less than the temperature difference threshold, setting value update unit 124 may then update the rotational speed of the motor included in blower 156 (the rotational speed of the fan rotated by the motor) to a rotational speed lower than the current rotational speed (details of which will be described later). Setting value update unit 124 may determine whether the temperature difference is less than the temperature difference threshold at a predetermined interval, and update the rotation speed to a rotation speed lower than the current rotation speed every time the temperature difference becomes less than the temperature difference threshold.

In the present exemplary embodiment, when the temperature difference between the outflow water temperature and the inflow water temperature is less than the temperature difference threshold, setting value update unit 124 may update the inflow water temperature threshold to a higher value (details of which will be described later).

When the inflow water temperature becomes higher than or equal to the inflow water temperature threshold, operation interrupter 127 stops the heating operation of heater 110, that is, stops the operation of heat pump unit 100.

Figure 3:
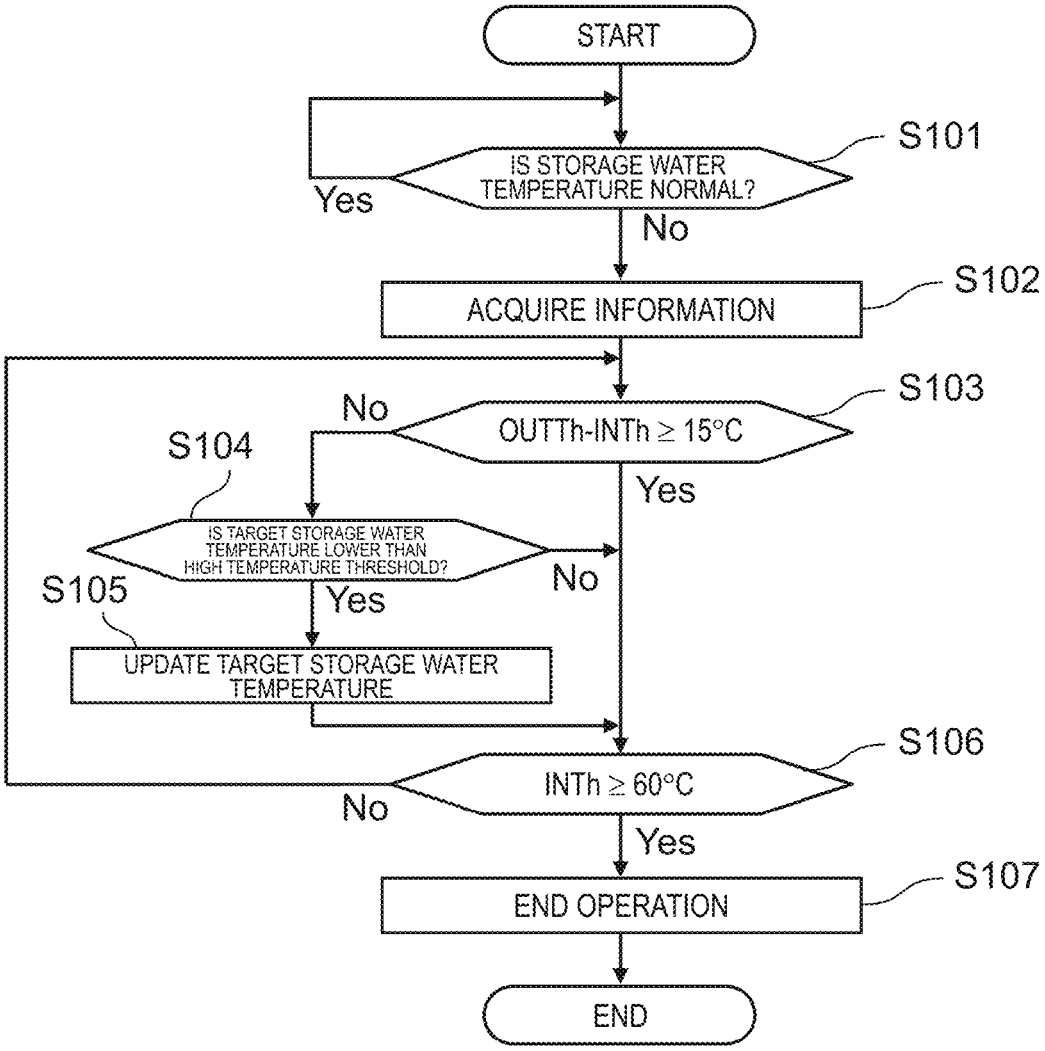
FIG. 3 is a flowchart illustrating the sequence of operations of the heat pump unit.

An operation of heat pump unit 100 will now be described. FIG. 3 is a flowchart illustrating the sequence of operations of heat pump unit 100. While heater 110 in heat pump unit 100 is heating the incoming water from hot water tank 310, normality determination unit 122 keeps determining whether storage water temperature sensor 311 is operating properly, that is, whether the storage water temperature obtained from storage water temperature sensor 311 is normal, at a predetermined time interval (step S101). Even if normality determination unit 122 determines that the storage water temperature is not being acquired properly (No in step S101), the heating operation of heat pump unit 100 is continued. After the point in time at which it is determined that the storage water temperature is not being acquired properly, controller 120 controls heat pump unit 100 using the two pieces of information of the inflow water temperature and the outflow water temperature, without using the storage water temperature obtained directly or indirectly from storage water temperature sensor 311.

Information acquisition unit 121 acquires the inflow water temperature and the outflow water temperature as pieces of information from inflow water temperature sensor 151 installed on the upstream side of heater 110 in the direction of the circulating water and outflow water temperature sensor 152 installed on the downstream side in the direction of the circulating water, respectively (step S102). Information acquisition unit 121 may acquire a target storage water temperature set by remote controller 325, for example. It is possible for information acquisition unit 121 to acquire the storage water temperature from storage water temperature sensor 311 installed in hot water tank 310, but the storage water temperature is not used for control.

Setting value update unit 124 then determines whether the temperature difference between the outflow water temperature (OUTTh) and the inflow water temperature (INTh) is less than the temperature difference threshold (step S103). In the present exemplary embodiment, the temperature difference threshold is 15° C., but without limitation thereto. If the temperature difference is less than the temperature difference threshold (No in step S103), setting value update unit 124 determines whether the target storage water temperature is lower than the high temperature threshold (step S104). If the target storage water temperature is lower than the high temperature threshold, setting value update unit 124 updates the target storage water temperature to be achieved in hot water tank 310 by the heating operation, to a value higher than the current value (step S105). For example, setting value update unit 124 may update the target storage water temperature using the following equation: target storage water temperature=target storage water temperature+temperature increase. The temperature increase is not limited to any value, but may be set to 5° C., as an example. The high temperature threshold is not limited to any value, but may be set to 90° C., as an example. If the target storage water temperature is higher than or equal to the high temperature threshold (Step S104, No), the target storage water temperature is not updated (step S105).

If the temperature difference between the outflow water temperature (OUTTh) and the inflow water temperature (INTh) is equal to or greater than the temperature difference threshold (Yes in step S103), setting value update unit 124 keeps determining whether the temperature difference between the outflow water temperature (OUTTh) and the inflow water temperature (INTh) is less than the temperature difference threshold at a predetermined interval until the inflow water temperature (INTh) reaches the inflow water temperature threshold (e.g., 60° C.) (No in step S106) (step S103). If the inflow water temperature (INTh) becomes higher than the predetermined temperature (e.g., 60° C.) (Yes in step S106), operation interrupter 127 ends the operation of heat pump unit 100 (step S107).

With the operation of heat pump unit 100 described above, even when storage water temperature sensor 311 exhibits anomaly, the water heating operation can be continued, by performing control using the inflow water temperature and the outflow water temperature. Therefore, a loss in the reliability of compressor 153 can be avoided.

Figure 4:
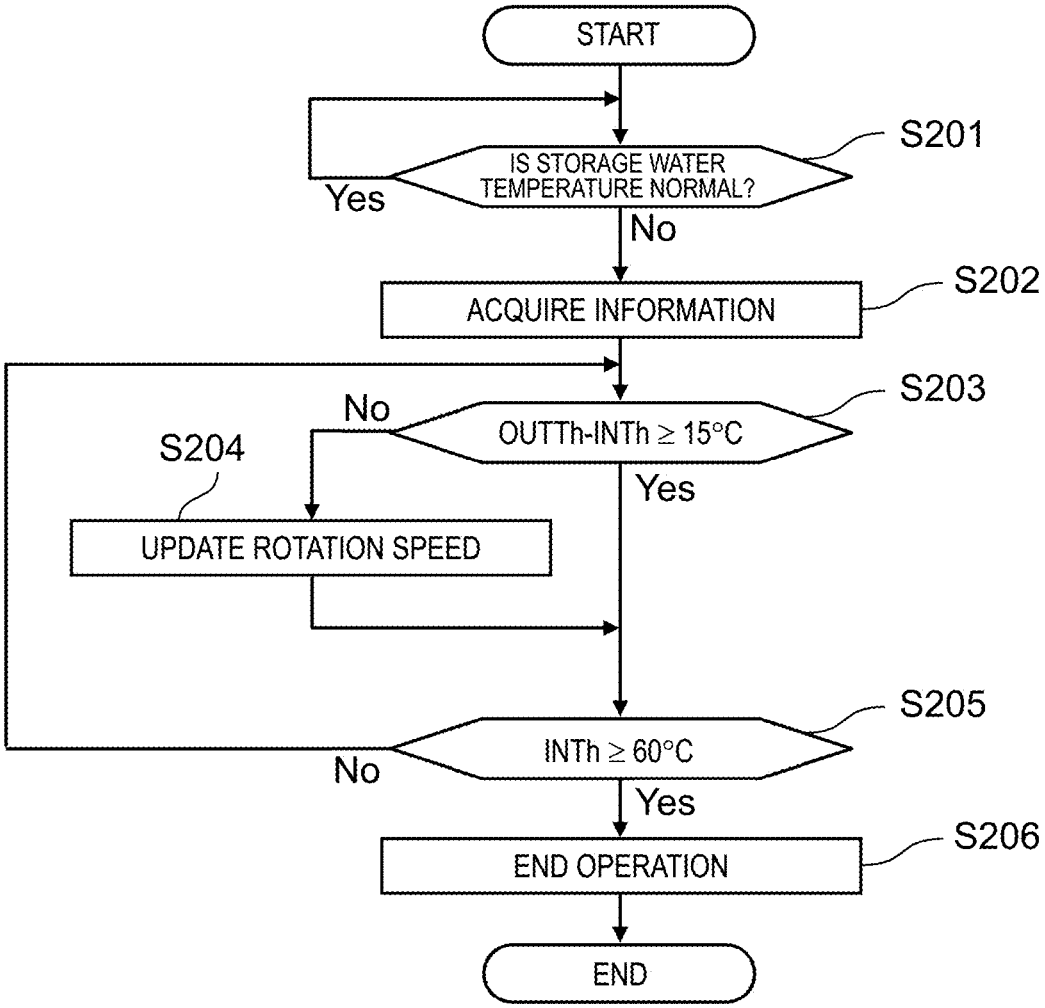
FIG. 4 is a flowchart illustrating another example 1 of the sequence of the operations of the heat pump unit.

Another example 1 of the operation of heat pump unit 100 will now be described. The other example 1 of the operation of heat pump unit 100 may be performed in parallel with the operation of heat pump unit 100 described above. FIG. 4 is a flowchart illustrating the other example 1 of the sequence of the operations of heat pump unit 100. While heater 110 in heat pump unit 100 is heating the incoming water from hot water tank 310, normality determination unit 122 keeps determining whether storage water temperature sensor 311 is operating properly, that is, whether the storage water temperature obtained from storage water temperature sensor 311 is normal, at a predetermined interval (step S201). Even if normality determination unit 122 determines that the storage water temperature is not being acquired properly (No in step S201), the operation of blower 156 in heat pump unit 100 is continued.

Information acquisition unit 121 acquires the inflow water temperature and the outflow water temperature from inflow water temperature sensor 151 and outflow water temperature sensor 152, respectively, as pieces of information (step S202). Information acquisition unit 121 may also acquire the rotation speed of the motor provided to blower 156 (the rotation speed of the fan).

Setting value update unit 124 then determines whether the temperature difference between the outflow water temperature (OUTTh) and the inflow water temperature (INTh) is less than the temperature difference threshold (step S203). If the temperature difference is less than the temperature difference threshold (No in step S203), the rotation speed of the motor of the blower 156 is updated to a value lower than the current value (step S204). For example, setting value update unit 124 may update the rotation speed of the motor using the following equation: rotation speed=rotation speed-speed decrease. The speed decrease is not limited to any value, but may be set to 50 rpm, as an example.

If the temperature difference between the outflow water temperature (OUTTh) and the inflow water temperature (INTh) is equal to or greater than the temperature difference threshold (Yes in step S203), setting value update unit 124 keeps determining whether the temperature difference between the outflow water temperature (OUTTh) and the inflow water temperature (INTh) is less than the temperature difference threshold at a predetermined interval until the inflow water temperature (INTh) reaches the inflow water temperature threshold (e.g., 60° C.) (No in step S205) (step S203). If the inflow water temperature (INTh) becomes higher than the incoming water threshold temperature (e.g., 60° C.) (Yes in step S205), operation interrupter 127 ends the operation of heat pump unit 100 (step S206).

With the operation of heat pump unit 100 according to the other example 1, even when storage water temperature sensor 311 exhibits anomaly, the water heating operation can be continued, and a loss in the reliability of compressor 153 can be avoided by reducing the heat exchange efficiency of air heat exchanger 155. In addition, energy consumption can be suppressed.

Note that the present disclosure is not limited to the above exemplary embodiment. For example, another exemplary embodiment implemented by optionally combining the components described in the present description or by excluding some of the components may be an exemplary embodiment of the present disclosure. In addition, the present disclosure also includes variations obtained by making various modifications conceivable by those skilled in the art without departing from the spirit of the present disclosure, in other words, without departing from the meaning indicated by the wording described in the claims. Therefore, another exemplary embodiment will be explained below.

Figure 5:
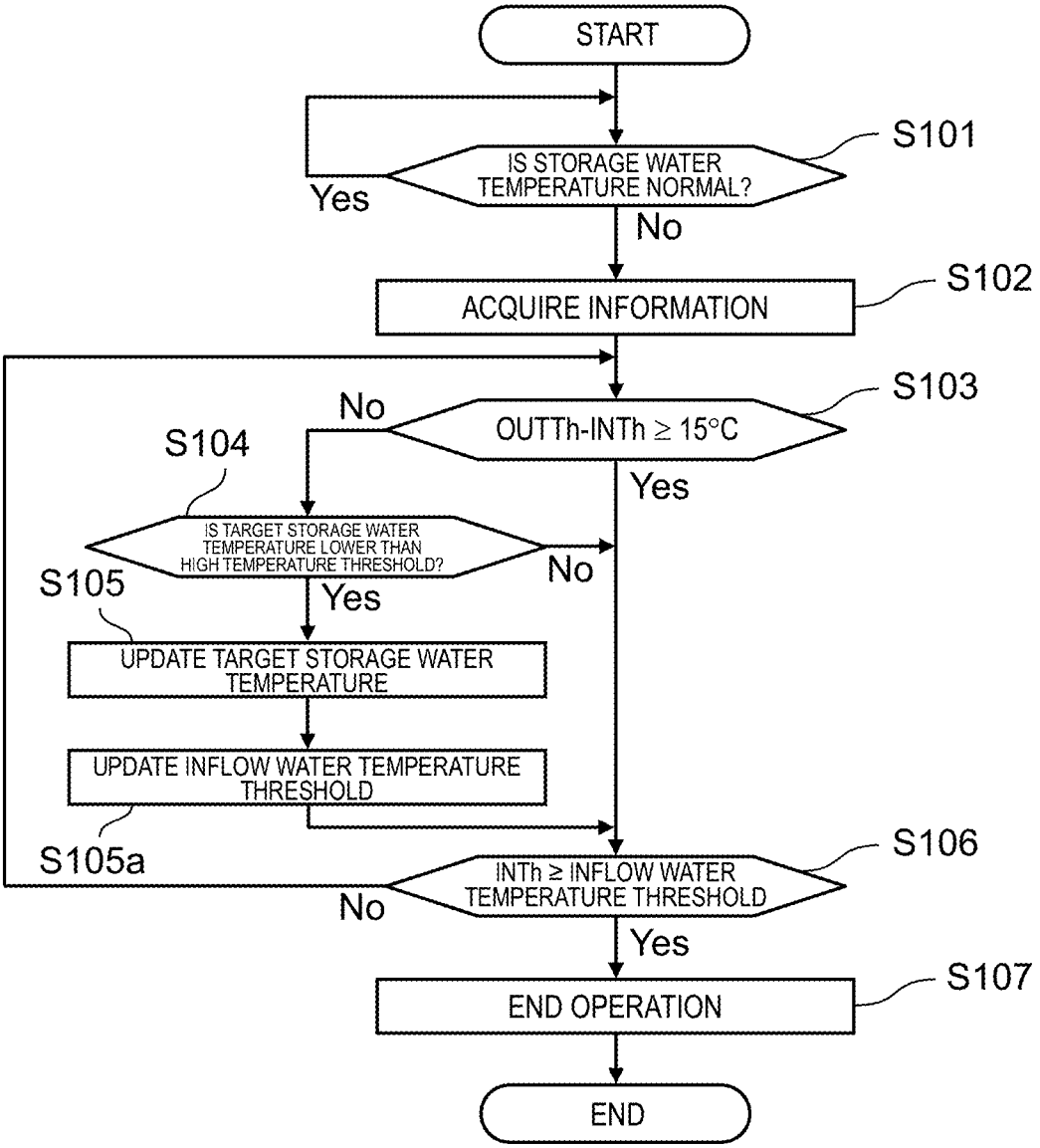
FIG. 5 is a flowchart illustrating another example 2 of the sequence of the operations of the heat pump unit.

Another example 2 of the operation of heat pump unit 100 will now be described. FIG. 5 is a flowchart illustrating another example 2 of the sequence of the operations of the heat pump unit 100. For example, as illustrated in FIG. 5, if the temperature difference between the outflow water temperature (OUTTh) and the inflow water temperature (INTh) is less than the temperature difference threshold (No in step S103), setting value update unit 124 may update the inflow water temperature threshold to a higher value (step S105*a*), in addition to the target storage water temperature (step S105). For example, setting value update unit 124 may update the inflow water temperature threshold by using the following equation: inflow water temperature threshold=inflow water temperature threshold+amount increased. The amount increased is not limited to any value, but may be set to 5° C., as an example. Note that the steps having the same numbers as those in FIG. 3 are the same operations, and therefore the description thereof will be omitted.

Although described above is an example in which information acquisition unit 121 acquires the storage water temperature indicating the temperature of the water in hot water tank 310, it is also possible for information acquisition unit 121 not to acquire the storage water temperature.

Although described in the exemplary embodiment is an example in which heat pump unit 100 includes pump 157, it is also possible for heat pump unit 100 not to include pump 157, and pump 157 may be provided to hot water system 300.

Heat pump unit 100 and the technology related to the heat pump unit can be implemented in various configurations as a whole or a part of equipment, an apparatus, an integrated circuit, a system, a method, a computer program, a non-volatile computer-readable recording medium, and the like.

Heat pump unit 100 according to a first aspect of the exemplary embodiment is a heat pump unit that heats water to be stored in hot water tank 310. Heat pump unit 100 according to the first aspect of the exemplary embodiment includes: heater 110 configured to heat water incoming from hot water tank 310 through heat exchange between the water and a heating medium having been heated based on compression and expansion; and controller 120 configured to control a heating operation of heater 110. Controller 120 includes information acquisition unit 121 configured to acquire an inflow water temperature indicating the temperature of the water flowing into the heater 110 from hot water tank 310, and an outflow water temperature indicating the temperature of the water flowing out of heater 110 toward hot water tank 310. Controller 120 further includes normality determination unit 122 that determines whether a storage water temperature indicating the temperature of the water inside hot water tank 310 is being acquired properly. Controller 120 further includes setting value update unit 124 configured to update a target storage water temperature to be achieved in hot water tank 310 by the heating operation to a higher value when normality determination unit 122 determines that the storage water temperature is not being acquired properly or there is a possibility that the storage water temperature is not being acquired properly, and a temperature difference between the outflow water temperature and the inflow water temperature is less than a temperature difference threshold.

According to the first aspect, even when the storage water temperature cannot be obtained properly, such as when storage water temperature sensor 311 is anomalous, the operation of heat pump unit 100 can be maintained by updating the target storage water temperature to a higher value. As a result, it is possible to ensure a large temperature difference between the heating medium flowing into compressor 153 and the heating medium flowing out of compressor 153, and a loss in the reliability of compressor 153 can be avoided.

Heat pump unit 100 according to a second aspect includes the first aspect, and setting value update unit 124 determines whether the temperature difference is less than the temperature difference threshold at a predetermined interval, and updates the target storage water temperature to a higher value every time the temperature difference becomes less than the temperature difference threshold.

According to the second aspect, it is possible to continue the operation of heat pump unit 100 so as to heat the water from hot water tank 310 while ensuring a large difference between the inflow water temperature and the outflow water temperature.

Heat pump unit 100 according to a third aspect includes the first aspect or the second aspect, and normality determination unit 122 determines that the storage water temperature is not being acquired properly when the temperature difference is less than the temperature difference threshold.

According to the third aspect, it is possible to detect that storage water temperature sensor 311 is not operating properly based on the information from the inflow water temperature sensor 151 and outflow water temperature sensor 152. According to the third aspect, the operations of heat pump unit 100 can be maintained while ensuring the reliability of compressor 153 on the basis of the information inside heat pump unit 100.

Heat pump unit 100 according to a fourth aspect includes any one of the first to third aspects, and setting value update unit 124 updates the inflow water temperature threshold to a higher value when the temperature difference is less than the temperature difference threshold. Furthermore, controller 120 includes operation interrupter 127 that stops the heating operation of heater 110 when the inflow water temperature becomes higher than or equal to the inflow water temperature threshold.

According to the fourth aspect, by updating the inflow water temperature to a higher value on the basis of a predetermined condition, it is possible to ensure the operation of heat pump unit 100 for a long period of time.

An anomaly workaround heating method according to a fifth aspect includes the following, in heat pump unit 100 including: heater 110 configured to heat water incoming from hot water tank 310 through heat exchange between the water and a heating medium having been heated based on compression and expansion; and controller 120 configured to control a heating operation of heater 110. That is, the anomaly workaround heating method according to the fifth aspect includes causing information acquisition unit 121 to acquire an inflow water temperature indicating a temperature of the water flowing into heater 110 from hot water tank 310, and an outflow water temperature indicating a temperature of the water flowing out of heater 110 toward hot water tank 310. The anomaly workaround heating method according to the fifth aspect also includes causing normality determination unit 122 to determine whether a storage water temperature indicating a temperature of the water inside hot water tank 310 is being acquired properly. The anomaly workaround heating method according to the fifth aspect also includes causing setting value update unit 124 to update a target storage water temperature to be achieved in hot water tank 310 by the heating operation, to a higher value, when normality determination unit 122 determines that the storage water temperature is not being acquired properly or there is a possibility that the storage water temperature is not being acquired properly, and a temperature difference between the outflow water temperature and the inflow water temperature is less than a temperature difference threshold.

According to the fifth aspect, even when the storage water temperature cannot be obtained properly, such as when storage water temperature sensor 311 is anomalous, the operation of heat pump unit 100 can be maintained by updating the target storage water temperature to a higher value. As a result, it is possible to ensure a large temperature difference between the heating medium flowing into compressor 153 and the heating medium flowing out of compressor 153, and a loss in the reliability of compressor 153 can be avoided.

A non-volatile computer-readable recording medium according to a sixth aspect records an anomaly workaround heating program executed in heat pump unit 100 that includes: heater 110 configured to heat water incoming from hot water tank 310 by heat exchange between the water and a heating medium heated based on compression and expansion; and controller 120 including the processor and configured to control a heating operation of heater 110, the anomaly workaround heating program causing the processor of controller 120 to execute following processing. The processing includes an information acquisition step of acquiring an inflow water temperature indicating a temperature of the water flowing from hot water tank 310 into heater 110 and an outflow water temperature indicating a temperature of the water flowing out of heater 110 toward hot water tank 310. The processing also includes a normality determination step of determining whether a storage water temperature indicating a temperature of the water inside hot water tank 310 is being acquired properly. The processing also includes a setting value update step of updating a target storage water temperature to be achieved in hot water tank 310 by the heating operation to a higher value when it is determined that, in the normality determination step, the storage water temperature is not being acquired properly or there is a possibility that the storage water temperature is not being acquired properly, and a temperature difference between the outflow water temperature and the inflow water temperature is less than a temperature difference threshold.

According to the sixth aspect, even when the storage water temperature cannot be obtained properly, such as when storage water temperature sensor 311 is anomalous, the operation of heat pump unit 100 can be maintained by updating the target storage water temperature to a higher value. As a result, it is possible to ensure a large temperature difference between the heating medium flowing into compressor 153 and the heating medium flowing out of compressor 153, and a loss in the reliability of compressor 153 can be avoided.

The heat pump unit according to the present disclosure is applicable to, for example, a hot water system that heats and supplies stored water, an air conditioning unit that heats the water for heating a room.

What is claimed is:

1. A heat pump unit configured to heat water to be stored in a hot water tank, the heat pump unit comprising:

a compressor configured to compress a heating medium;

an expansion valve configured to expand the heating medium;

a heater configured to heat water flowing out of the hot water tank, through heat exchange between the water and the heating medium having been heated based on compression and expansion;

an inflow water temperature sensor configured to sense an inflow water temperature indicating a temperature of the water flowing out of the hot water tank into the heater;

an outflow water temperature sensor configured to sense a temperature of the water flowing out of the heater toward the hot water tank; and a controller configured to control a heating operation of the heater, wherein the controller is further configured to:

obtain the inflow water temperature, the outflow water temperature, and a temperature of the water inside the hot water tank;

determine whether the storage water temperature is being obtained properly; and control the heating operation of the heater by updating a target storage water temperature to be achieved in the hot water tank by the heating operation to a higher value when the controller determines that the storage water temperature is not being obtained properly or there is a possibility that the storage water temperature is not being obtained properly, and a temperature difference between the outflow water temperature and the inflow water temperature is less than a temperature difference threshold.

2. The heat pump unit according to claim 1, wherein the controller is further configured to determine whether the temperature difference is less than the temperature difference threshold at a predetermined interval, and to update the target storage water temperature to a higher value every time the temperature difference becomes less than the temperature difference threshold.

3. The heat pump unit according to claim 1, wherein the controller is further configured to determine that the storage water temperature is not being obtained properly when the temperature difference is less than the temperature difference threshold.

4. The heat pump unit according to claim 1, wherein the controller is further configured to update an inflow water temperature threshold to a higher value when the temperature difference is less than the temperature difference threshold, and the controller includes an operation interrupter configured to stop the heating operation of the heater when the inflow water temperature becomes higher than or equal to the inflow water temperature threshold.

5. An anomaly workaround heating method executed in a heat pump unit, the heat pump unit comprising a compressor configured to compress a heating medium; an expansion valve configured to expand the heating medium; a heater configured to heat water flowing out of the hot water tank, through heat exchange between the water and the heating medium having been heated based on compression and expansion; an inflow water temperature sensor configured to sense an inflow water temperature indicating a temperature of the water flowing out of the hot water tank into the heater; an outflow water temperature sensor configured to sense a temperature of the water flowing out of the heater toward the hot water tank; and a controller configured to control a heating operation of the heater, the anomaly workaround heating method comprising:

obtaining the inflow water temperature, the outflow water temperature, and a temperature of the water inside the hot water tank;

determining whether the storage water temperature is being obtained properly; and controlling the heating operation of the heater by updating the target storage water temperature to be achieved in the hot water tank by the heating operation to a higher value when the controller determines that the storage water temperature is not being obtained properly or there is a possibility that the storage water temperature is not being obtained properly, and a temperature difference between the outflow water temperature and the inflow water temperature is less than a temperature difference threshold.

6. A non-transitory computer-readable recording medium storing an anomaly workaround heating program executed in the heat pump unit, the heat pump unit comprising a compressor configured to compress a heating medium; an expansion valve configured to expand the heating medium; a heater configured to heat water flowing out of the hot water tank, through heat exchange between the water and the heating medium having been heated based on compression and expansion; an inflow water temperature sensor configured to sense an inflow water temperature indicating a temperature of the water flowing out of the hot water tank into the heater; an outflow water temperature sensor configured to sense a temperature of the water flowing out of the heater toward the hot water tank; and a controller configured to control a heating operation of the heater, the anomaly workaround heating program causing a processor of the controller to execute steps of:

obtaining the inflow water temperature, the outflow water temperature, and a temperature of the water inside the hot water tank;

determining whether the storage water temperature is being obtained properly; and controlling the heating operation of the heater by updating the target storage water temperature to be achieved in the hot water tank by the heating operation to a higher value when the controller determines that the storage water temperature is not being obtained properly or there is a possibility that the storage water temperature is not being obtained properly, and a temperature difference between the outflow water temperature and the inflow water temperature is less than a temperature difference threshold.

* * * * *